US005367927A

United States Patent [19]

Frettered

[11] Patent Number: 5,367,927

[45] Date of Patent: Nov. 29, 1994

[54] MOTORCYCLE CLUTCH ASSEMBLY REMOVAL TOOL AND METHOD THEREFOR

[76] Inventor: Vincent T. Frettered, 171 W. Fern, Woodland Park, Colo. 80863

[21] Appl. No.: 951,667

[22] Filed: Sep. 25, 1992

[51] Int. Cl.[5] ..... B25B 27/00

[52] U.S. Cl. ..... 81/488; 29/244

[58] Field of Search ..... 81/488, 486; 29/244, 29/256, 258, 266, 225, 227

[56] References Cited

U.S. PATENT DOCUMENTS

| | | | |
|---|---|---|---|
| 1,581,129 | 4/1926 | Jordy | 29/266 |
| 2,151,616 | 3/1939 | Redell et al. | 29/256 |
| 4,542,571 | 9/1985 | Sullivan | 29/258 |

FOREIGN PATENT DOCUMENTS

| | | | |
|---|---|---|---|
| 0625092 | 4/1927 | France | 29/266 |

*Primary Examiner*—Roscoe V. Parker

*Attorney, Agent, or Firm*—Glenn L. Webb

[57] ABSTRACT

A clutch removal tool formed of an elongated member having a center portion with opposing semi-circular portions. A hole is formed in this center portion for engaging over the pushrod adjusting screw of a motorcycle clutch assembly. The clutch removal tool also includes opposing end portions tapering inwardly away from the center portion. The length of clutch removal tool enables the end portions to make contact against the clutch assembly spring collar without interference with the spring tension adjusting nuts. In use, the clutch removal tool is installed over the pushrod adjusting screw. The end portions engage against the spring collar. The pushrod adjusting screw locknut is tightened against the clutch removal tool. This releases the pressure against the spring tension adjusting nuts. The spring tension adjusting nuts can be easily removed without interference from the clutch removal tool. Once the spring tension adjusting nuts are removed, the pressure plate assembly is removed.

21 Claims, 4 Drawing Sheets

MOTORCYCLE CLUTCH ASSEMBLY REMOVAL TOOL AND METHOD THEREFOR

BACKGROUND OF THE INVENTION

1. Field of the Invention

This invention relates to the field of tools for motorcycles, and particularly to the field of tools for the removal of clutch assemblies of vintage motorcycles.

2. Statement of the Problem

Motorcycles are owned and operated by large numbers of people. These motorcycles, particularly older vintage motorcycles, must undergo regular maintenance procedures in order to operate properly. Also, these motorcycles typically require frequent repairs.

One popular category of vintage motorcycles include vintage Harley-Davidson motorcycles. This category of vintage motorcycles include the model years 1936–1947 Knucklehead series, 1948–1965 Panhead series and 1966–1984 Shovelhead series. Frequent maintenance and repair is necessary to keep these older motorcycles operating properly. Also, upgrades are often done to these motorcycles to improve their performance. These maintenance procedures and repairs are performed not only by skilled mechanics and technicians, but also by the motorcycle owners and operators.

Often, maintenance, repair and/or upgrading of the clutch, primary drive and transmission is necessary. The clutch plates often require adjustment or replacement as well as the chain sprockets, the transmission seals and the primary drive components. These procedures require the removal of the clutch assembly from the motorcycle. In normal operation, the clutch assembly is removed from the motorcycle up to twenty-four times a year. This procedure may even be necessary while the motorcycle is inaccessible to a repair shop. For instance, a clutch adjustment may be necessary while the motorcycle is being ridden some distance from the rider's home or a repair shop. Many operators are normally capable of performing most minor repairs on these motorcycles. In order to make repairs involving removal of the clutch assembly, the operator must have the necessary tools.

The recommended procedure for removing the clutch assembly requires, in addition to a normal complement of tools, at least one, and typically several, flat circular washers of certain inside and outside diameters. The procedure involves removing the primary chain case cover to expose the clutch assembly. The pushrod adjusting screw locknut is removed from the pushrod adjusting screw. Either a single flat circular washer having specific dimensions (typically $\frac{1}{8}$ inch thick, 1-$\frac{3}{4}$ inch outside diameter and $\frac{3}{8}$ inch inside diameter) or several circular washers stacked together are used to arrive at the appropriate outside and inside diameters. These circular washers are inserted over the pushrod adjusting screw to seat against the spring collar. The pushrod adjusting screw locknut is replaced and tightened to place pressure on the circular washers against the spring collar. The pushrod adjusting screw locknut is tightened until the clutch spring adjusting nuts are loose. The clutch spring adjusting nuts are then removed to allow the pressure plate, the clutch springs and the spring collar to be removed as an assembly from the clutch hub.

The circular washers are necessary to maintain the pressure on the clutch springs in order to keep the pressure plate assembly intact. It is quite difficult to mount the pressure plate assembly on the motorcycle once the springs are released. However, there are many problems associated with the use of these circular washers.

Normally, the required circular washers are selected from an assortment of circular washers. The individual making the repairs must sort through a variety of circular washers in order to find the appropriate sizes for the removal of the clutch assembly. Not only is this time-consuming, but the circular washers often get spilled during the repair process.

Also, the appropriate sizes of circular washers may not always be available. This is particularly true when the repair must be done on the road. The operator may not have a wide assortment of circular washers to choose from in order to make a critical repair. Different sizes of circular washers may need to be stacked in order to have the appropriate outside and inside diameters. The stacking of these circular washers makes it more difficult to replace the pushrod adjusting screw locknut back onto the pushrod adjusting screw. Even when appropriately sized circular washers have been selected, these circular washers are easily lost. This is particularly true when time passes between the clutch assembly removal processes.

An additional problem arises after the circular washers have been placed over the pushrod adjusting screw. The outside diameter of the circular washers often interferes with the removal of the spring tension adjusting nuts. If the precise diameter circular washer is not available, then there is little room to remove these nuts from the clutch assembly in order to remove the pressure plate assembly.

Once the repair has been made and the clutch assembly is mounted on the motorcycle, a problem often occurs with the removal of the circular washers from the spring collar. The clutch assembly in these vintage motorcycles is mounted in a thick oil bath. This oil creates a vacuum between the circular washers and the clutch assembly. This vacuum/friction on the circular washers causes removal of the circular washer from the spring collar to be quite difficult. The spring tension adjusting nuts also make it difficult to gain a finger grip on the circular washers.

Thus, a problem exists in that presently there is no specific tool designed to be used in the removal of motorcycle clutch assemblies.

3. Solution to the Problem

The present invention solves this problem and others by providing a tool specifically designed to assist in the removal of motorcycle clutch assemblies.

The clutch removal tool of the present invention has an elongated configuration to prevent interference with the spring tension adjusting nuts of the clutch assembly. The elongated configuration also minimizes the frictional surface area between the clutch removal tool and clutch assembly cover plate. This configuration enables the clutch removal tool to be easily removed from the cover plate. The clutch removal tool shape allows fingers to grasp the sides of the clutch removal tool to pull or pry the clutch removal tool off of the cover plate if necessary.

The clutch removal tool of the present invention is easily stored, either in a tool chest, tool kit or key chain. This allows the clutch removal tool to be readily available when needed. The clutch removal tool can be kept in the repair shop or easily carried by rider.

The clutch removal tool eliminates the need for sorting through an assortment of circular washers whenever it is necessary to remove the motorcycle clutch assembly. The clutch removal tool of the present invention enables the removal of a motorcycle clutch assembly without the problems associated with the use of circular washers. A precise tool is available whenever the clutch assembly is to be removed. This clutch removal tool can be included in tool kits on the motorcycle so the repair can be performed wherever necessary.

The clutch removal tool of the present invention is fully disclosed in the description of the invention and the drawings.

SUMMARY OF THE INVENTION

The present invention provides a specific tool for use in removing the clutch assembly from many motorcycles. This clutch removal tool greatly simplifies the motorcycle clutch assembly removal process.

The clutch removal tool includes an elongated member having a center portion with opposing semi-circular portions. A hole is formed in this center portion for engaging over the pushrod adjusting screw of a motorcycle clutch assembly. The clutch removal tool also includes opposing end portions tapering inwardly away from the center portion. The clutch removal tool is formed of a high strength cast or machined aluminum alloy.

The length of clutch removal tool enables the end portions to make contact against the clutch assembly spring collar without interference with the spring tension adjusting nuts. The length and width of the clutch removal tool also presents minimal cross-sectional area contacting the spring collar. This is important in reducing the vacuum/friction tension that arises from the oil on the spring collar and the clutch removal tool. The shape of the clutch removal tool also enables ease in grasping the clutch removal tool. This allows the clutch removal tool to be easily removed once the clutch assembly has been reinstalled on the motorcycle.

The center hole also provides a convenient and secure way of storing the clutch removal tool when not in use. The clutch removal tool can be clipped onto a key chain so it is readily available when needed. The clutch removal tool can also be stored on a peg in a workshop or toolbox. This saves time and effort in searching for the clutch removal tool when needed.

In use, the clutch removal tool is installed ever the pushrod adjusting screw. The end portions engage against the spring collar. The pushrod adjusting screw locknut is tightened against clutch removal tool. This releases the pressure against the spring tension adjusting nuts. The spring tension adjusting nuts can be easily removed without interference from clutch removal tool. Once the spring tension adjusting nuts are removed, the pressure plate, the clutch springs and the spring collar are removed as an assembly.

This pressure plate assembly is normally preferred to be kept intact. Once the tension on the springs is removed, it can be difficult to reassemble the springs and the pressure plate. The repairs or adjustments can now be performed on the clutch, primary drive or transmission on the motorcycle.

After these repairs or adjustments have been performed, the clutch assembly, including the pressure plate assembly, is reinstalled on the clutch hub. The spring tension adjusting nuts are tightened onto the clutch hub bolts. At this point, the pushrod adjusting screw locknut is removed. The clutch removal tool is easily grasped about the center portion to be removed from the spring collar. The size and shape of the clutch removal tool minimizes any sticking of the tool to the spring collar due to the vacuum and friction created by oil on the spring collar. The pushrod adjusting screw locknut is reinstalled on the pushrod adjusting screw and the clutch cover is replaced. The clutch removal tool can be clipped onto a key chain or into a toolbox until it is next needed.

These and other features of the present invention will be evident from the drawings and the detailed description of a preferred embodiment.

DETAILED DESCRIPTION OF A PREFERRED EMBODIMENT

Figure 1:
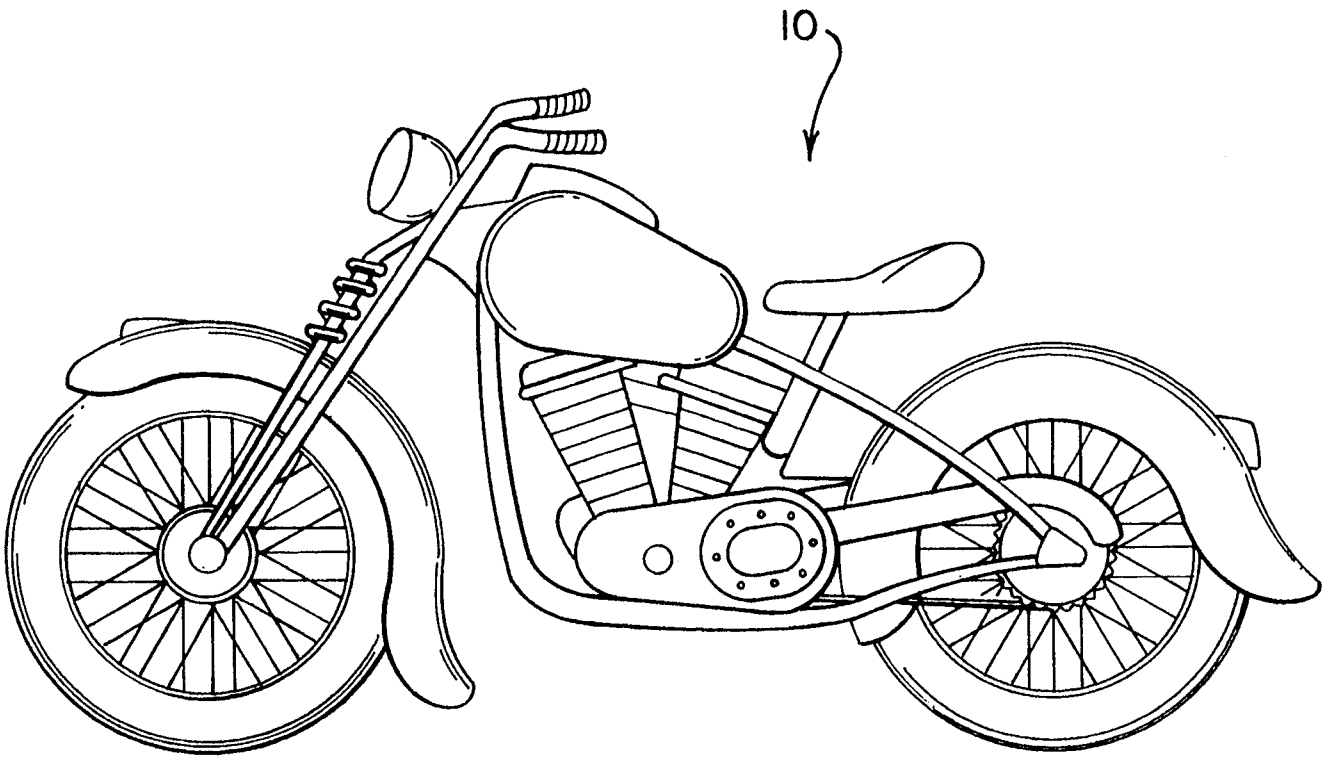
FIG. 1 is a perspective view of a motorcycle of the type on which the present invention is intended for use.

The present invention provides a clutch removal tool and technique for removing the clutch assembly from a motorcycle. This invention has particular application for vintage motorcycles, primarily 1936–1984 Harley-Davidson motorcycles, similar to motorcycle 10 shown FIG. 1.

It is to be expressly understood that the present invention is not to be limited by the description of an explanatory preferred embodiment. The scope of the inventive concept includes other variations and embodiments on the clutch removal tool and technique for using the clutch removal tool to remove clutch assemblies.

Figure 2:
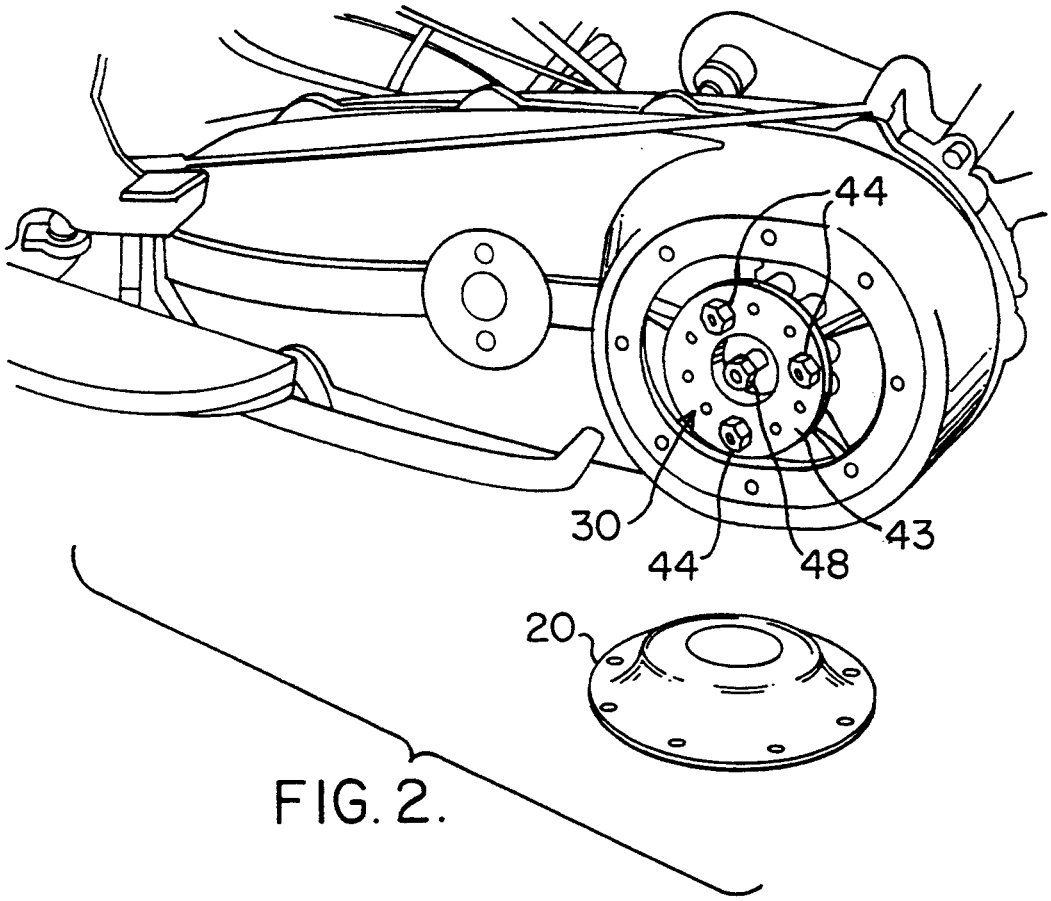
FIG. 2 shows the clutch assembly of a motorcycle exposed.

As discussed in the background section of the disclosure, the clutch assembly must frequently be removed in order to repair, maintain and/or upgrade the clutch, the primary drive and the transmission of these motorcycles. Access to the motorcycle clutch assembly, in the descriptive embodiment, is typically gained by removing left primary chain case cover 20 as shown in FIG. 2. This exposes the clutch assembly, including the pressure plate assembly 30. Other structure, such as the compensating sprocket, may need to be removed as well depending on the model of the motorcycle.

Figure 3:
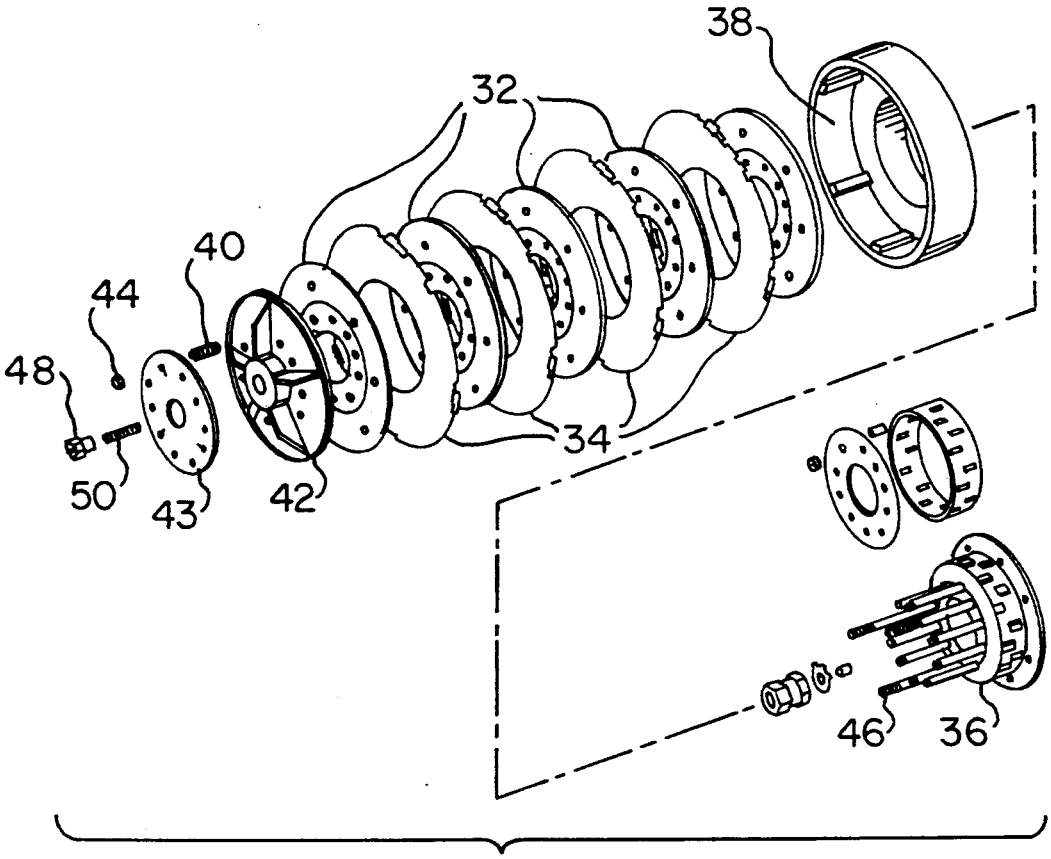
FIG. 3 is an exploded view of a typical motorcycle clutch assembly.

The clutch assembly on which the present invention has application typically includes multiple friction disks 32, shown in FIG. 3, with alternate plates 34 splined to the clutch hub 36 and clutch shell 38. When the clutch is engaged, springs 40 (only one of which is shown) force plates 32, 34 together, causing them to turn as a unit. This transmits engine power through the chain or belt to the rear wheel to drive the motorcycle.

A plurality of springs 40 (only one of which is shown) are mounted between spring collar 43 and pressure plate 42. Spring tension adjusting nuts 44 (only one of which is shown) engage bolts 46 on clutch hub 36 to secure pressure plate 42 against the pressure of springs 40. Pushrod adjusting screw locknut 48 engages pushrod adjusting screw 50.

Figure 4:
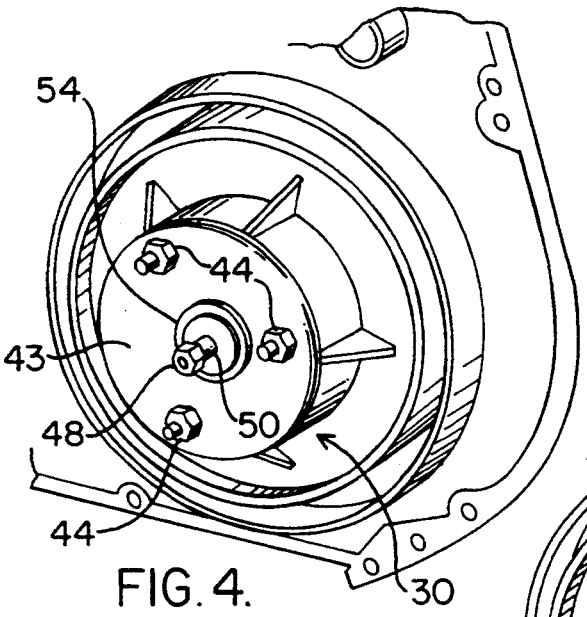
FIG. 4 is a view of the prior art technique for removing a motorcycle clutch assembly.

The prior art techniques for removing clutch assembly 30 from the motorcycle require the use of one or several flat circular washers, as discussed fully in the background section of the disclosure. As shown in FIG. 4, this technique requires removal of pushrod adjusting screw locknut 48 from pushrod adjusting screw 50. Ideally, a single flat circular washer or a plurality of stacked washers 54 are placed over pushrod adjusting screw 50. Pushrod adjusting screw locknut 48 is replaced on pushrod adjusting screw 50. Locknut 48 is tightened against circular washer 54 until the tension in spring tension adjusting nuts 44 is released. Spring tension adjusting nuts 44 are removed and pressure plate 42, springs 40 and spring collar 43 are removed as an intact assembly from clutch hub 36. Without the use of circular washers 54, springs 40 are released which creates an extremely difficult task of replacing the component parts of the pressure plate assembly.

The use of circular washers 54 have a number of problems, as discussed in detail in the background section of the disclosure. The present invention is able to overcome these problems.

Figure 5:
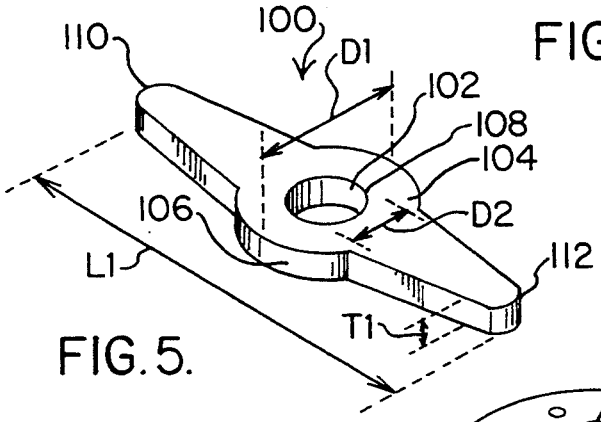
FIG. 5 is a view of a preferred embodiment of the clutch removal tool of the present invention.

A preferred embodiment of the clutch removal tool of the present invention is illustrated in FIG. 5. Again, it is to be expressly understood that this exemplary embodiment is for descriptive purposes only and is not meant to unduly limit the scope of the inventive concept.

Clutch removal tool 100, shown in FIG. 5, includes center portion 102 having opposing semi-circular portions 104, 106. Center portion 102 includes a cross-sectional diameter $D_1$ of about three-quarters (0.750) of an inch. Center hole 108 is formed in the center of center portion 102. Center hole 108 has a diameter $D_2$ of about three-eights (0.375) inches. Clutch removal tool 100 also includes opposing end portions 110, 112 which taper inwardly away from center portion 102. The overall length $L_1$ of clutch removal tool 100 is about one and one-half (1.5) to two (2.0) inches. Clutch removal tool 100 is formed of a high strength cast or machined aluminum alloy and has a thickness $t_1$ of about one-eighth (0.125) to one-quarter (0.250) inches.

It is to be expressly understood that the present invention is not meant to be limited to the above described configuration. Other embodiments are considered to be within the scope of the inventive concept. For instance, end portions 110, 112 may have tool ends formed thereon. Also, while a semi-cylindrical center portion 102 is considered to be the most effective shape, other shapes may be used. The dimensions of clutch removal tool 100 can also be varied as desired. Clutch removal tool 100 can also be formed of any relatively high strength material as desired. The clutch removal tool can be formed by machining, casting or, in the case of plastic, molding.

Center hole 108 has an inside diameter sized to fit over the pushrod rod adjusting screw of the motorcycle clutch assembly. The length of clutch removal tool 100 enables the end portions 110, 112 to make contact against the clutch assembly cover plate without interference with the spring tension adjusting nuts. The length and width of the clutch removal tool also presents minimal cross-sectional area contacting the clutch assembly cover plate. This is important in reducing the vacuum/friction tension that arises from the oil on the clutch assembly cover plate and the clutch removal tool. The shape of the clutch removal tool also enables ease in grasping the clutch removal tool. This allows the clutch removal tool to be easily removed once the clutch assembly has been reinstalled on the motorcycle.

Center hole 108 also provides a convenient and secure way of storing clutch removal tool 100 when not in use. Clutch removal tool 100 can be clipped onto a key chain so it is readily available when needed. Clutch removal tool 100 can also be stored on a peg in a workshop or toolbox. This saves time and effort in searching for the clutch removal tool when needed.

OPERATION

Figure 6:
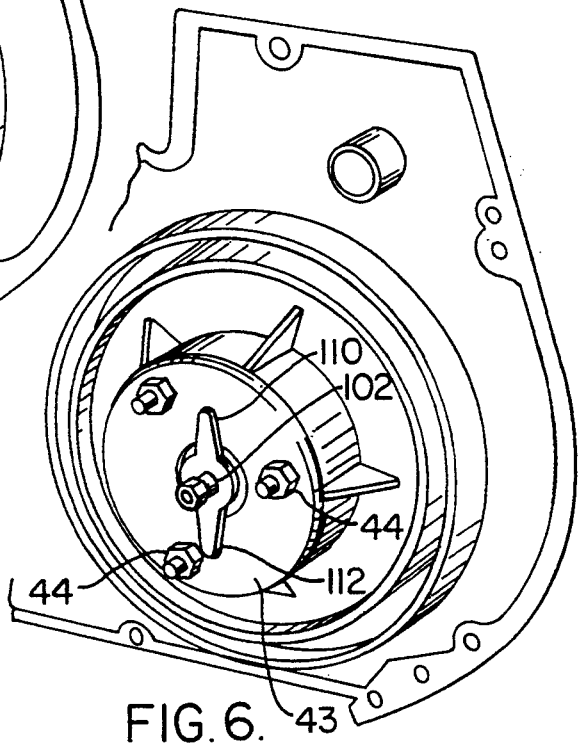
FIG. 6 is a view of the clutch removal tool of FIG. 5 installed on a motorcycle clutch assembly.
Figure 7:
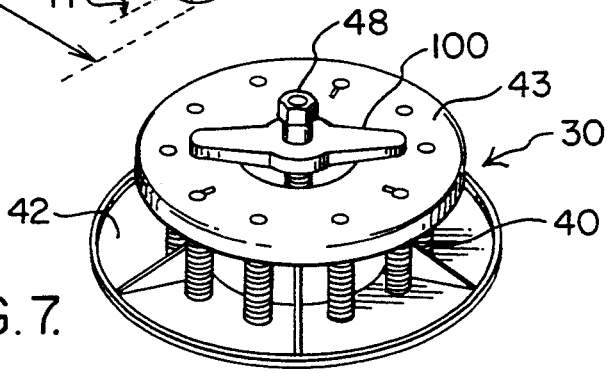
FIG. 7 is a view of a pressure plate assembly removed with the clutch removal tool of FIG. 5.

The technique of using clutch removal tool 100 is illustrated in FIGS. 6 and 7. The technique is similar to the prior art technique described above with the Improvements allowed by the clutch removal tool of the present invention. Center hole 108 is placed over pushrod adjusting screw 50 to install clutch removal tool 100. End portions 110, 112 engage against spring collar 43. Pushrod adjusting screw locknut 48 is tightened against center portion 102 of clutch removal tool 100. This releases the pressure against spring tension adjusting nuts 44. Spring tension adjusting nuts 44 can be easily removed without interference from clutch removal tool 100. Once spring tension adjusting nuts 44 are removed, the entire pressure plate assembly 30 is removed, as shown in FIG. 7.

Pressure plate assembly 30 is normally preferred to be kept intact. Once the tension on springs 40 is removed, it can be difficult to reassembly pressure plate assembly 30. The repairs or adjustments can now be performed on the clutch, primary drive or transmission on the motorcycle.

After these repairs or adjustments have been performed, pressure plate assembly 30 is reinstalled on bolts 46 on clutch hub 36. Spring tension adjusting nuts 44 are tightened onto bolts 46. At this joint, pushrod adjusting screw locknut 48 is removed. Clutch removal tool 100 is easily grasped about central portion 102 to be removed from spring collar 43. Pushrod adjusting screw locknut 48 is reinstalled on pushrod adjusting screw 50 and the clutch cover replaced. Clutch removal tool 100 can be clipped onto a key chain or into a toolbox until it is next needed.

As discussed above, other variations on this embodiment include differing shapes of clutch removal tool 100. The end portions 110, 112 can include tool ends, such as screwdriver tips. Also, the center portion can be of different shapes rather than the preferred semi-cylindrical configuration.

The clutch removal tool can also be anodized if desired. Company or club logos can be imprinted on the sides of the clutch removal tool as well. Other variations and embodiments are considered to be within the scope of the claimed inventive concept.

I claim:

1. A clutch removal tool for removing clutch assemblies from motorcycles, said clutch removal tool comprising:

an elongated member having a central portion;

a hole formed in said central portion of said elongated member for engagement over a pushrod adjusting screw of a motorcycle clutch assembly;

a first end portion on said elongated member having a cross-sectional width of about one-quarter inch to one-half inch for engaging the spring collar of the motorcycle clutch assembly without interfering with the spring tension adjusting nuts of the motorcycle clutch assembly; and a second end portion on said elongated member having a cross-sectional width of about one-quarter inch to one-half inch for engaging the spring collar of the motorcycle clutch assembly without interfering with the spring tension adjusting nuts of the motorcycle clutch assembly.

2. The clutch removal tool of claim 1 wherein said first end portion has a cross-sectional width less than the cross-sectional width of said central portion of said elongated member; and said second end portion has a cross-sectional width less than the cross-sectional width of said central portion of said elongated member.

3. A clutch removal tool for removing clutch assemblies from motorcycles, said clutch removal tool comprising:

an elongated member formed of high strength aluminum alloy and having a central portion;

a hole formed in said central portion of said elongated member for engagement over a pushrod adjusting screw of a motorcycle clutch assembly;

a first end portion on said elongated member for engaging the spring collar of the motorcycle clutch assembly without interfering with the spring tension adjusting nuts of the motorcycle clutch assembly; and a second end portion on said elongated member for engaging the spring collar of the motorcycle clutch assembly without interfering with the spring tension adjusting nuts of the motorcycle clutch assembly.

4. The clutch removal tool of claim 1 wherein said central portion of said elongated member has opposing sides formed in substantially semi-circular configurations.

5. The clutch removal tool of claim 1 wherein said first end portion tapers inwardly from said central portion of said elongated member; and said second end portion tapers inwardly from said central portion of said elongated member.

6. A clutch removal tool for removing clutch assemblies from motorcycles, said clutch removal tool comprising:

an elongated member having a length of about one and one-half inches to two inches and a central portion;

a hole formed in said central portion of said elongated member for engagement over a pushrod adjusting screw of a motorcycle clutch assembly;

a first end portion on said elongated member for engaging the spring collar of the motorcycle clutch assembly without interfering with the spring tension adjusting nuts of the motorcycle clutch assembly; and a second end portion on said elongated member for engaging the spring collar of the motorcycle clutch assembly without interfering with the spring tension adjusting nuts of the motorcycle clutch assembly.

7. A clutch removal tool for removing clutch assemblies from motorcycles, said clutch removal tool comprising:

an elongated member having and a central portion;

a hole having an inside diameter of about three-eighths inch formed in said central portion of said elongated member for engagement over a pushrod adjusting screw of a motorcycle clutch assembly;

a first end portion on said elongated member for engaging the spring collar of the motorcycle clutch assembly without interfering with the spring tension adjusting nuts of the motorcycle clutch assembly; and a second end portion on said elongated member for engaging the spring collar of the motorcycle clutch assembly without interfering with the spring tension adjusting nuts of the motorcycle clutch assembly.

8. A clutch removal tool for removing clutch assemblies from motorcycles, said clutch removal tool comprising:

an elongated member having a central portion;

a hole having formed in said central portion of said elongated member for engagement over a pushrod adjusting screw of a motorcycle clutch assembly;

a first end portion on said elongated member for engaging the spring collar of the motorcycle clutch assembly without interfering with the spring tension adjusting nuts of the motorcycle clutch assembly;

a second end portion on said elongated member for engaging the spring collar of the motorcycle clutch assembly without interfering with the spring tension adjusting nuts of the motorcycle clutch assembly; and said clutch removal tool has a thickness of about one-eight to three-eighths inch.

9. A clutch removal tool for removing clutch assemblies from motorcycles, said clutch removal tool comprising:

an elongated member having a length of about one and one-half to two inches and a thickness of about one-eight to three eights inch and having a central portion;

a hole having an inside diameter of about three-eighths inch formed in said central portion of said elongated member for engagement over a pushrod adjusting screw of a motorcycle clutch assembly;

a first end portion on said elongated member having a cross-sectional width of about one-quarter to one-half inches and less than the cross-sectional width of said central portion for engaging the spring collar of the motorcycle clutch assembly without interfering with the spring tension adjusting nuts of the motorcycle clutch assembly; and a second end portion on said elongated member having a cross-sectional width of about one-quarter to one-half inches and less than the cross-sectional width of said central portion for engaging the spring collar of the motorcycle clutch assembly without interfering with the spring tension adjusting nuts of the motorcycle clutch assembly.

10. The clutch removal tool of claim 9 wherein said central portion of said elongated member has opposing sides having substantially semi-circular configurations.

11. The clutch removal tool of claim 10 wherein said first end portion tapers inwardly from said central portion of said elongated member; and said second end portion tapers inwardly from said central portion of said elongated member.

12. The clutch removal tool of claim 3 wherein said first end portion has a cross-sectional width less than the cross-sectional width of said central portion of said elongated member; and said second end portion has a cross-sectional width less than the cross-sectional width of said central portion of said elongated member.

13. The clutch removal tool of claim 6 wherein said first end portion has a cross-sectional width less than the cross-sectional width of said central portion of said elongated member; and said second end portion has a cross-sectional width less than the cross-sectional width of said central portion of said elongated member.

14. The clutch removal tool of claim 7 wherein said first end portion has a cross-sectional width less than the cross-sectional width of said central portion of said elongated member; and said second end portion has a cross-sectional width less than the cross-sectional width of said central portion of said elongated member.

15. The clutch removal tool of claim 8 wherein said first end portion has a cross-sectional width less than the cross-sectional width of said central portion of said elongated member; and said second end portion has a cross-sectional width less than the cross-sectional width of said central portion of said elongated member.

16. The clutch removal tool of claim 3 wherein said first end portion tapers inwardly from said central portion of said elongated member; and said second end portion tapers inwardly from said central portion of said elongated member.

17. The clutch removal tool of claim 6 wherein said first end portion tapers inwardly from said central portion of said elongated member; and said second end portion tapers inwardly from said central portion of said elongated member.

18. The clutch removal tool of claim 7 wherein said first end portion tapers inwardly from said central portion of said elongated member; and said second end portion tapers inwardly from said central portion of said elongated member.

19. The clutch removal tool of claim 8 wherein said first end portion tapers inwardly from said central portion of said elongated member; and said second end portion tapers inwardly from said central portion of said elongated member.

20. A method for removing the clutch assembly from a motorcycle using an elongated clutch removal tool having a center hole and opposing end portions with reduced widths, said method comprising the steps of:

(a) removing the pushrod adjusting screw locknut from the pushrod adjusting screw;

(b) placing said center hole of said elongated clutch removal tool over said pushrod adjusting screw so that said end portions of said elongated clutch removal tool does not interfere with the spring tension adjusting nuts;

(c) tightening the pushrod adjusting screw locknut against said elongated clutch removal tool so said elongated clutch removal tool engages the cover plate of the clutch assembly;

(d) removing the spring tension adjusting nuts from the clutch assembly once the tension has been removed from the spring tension adjusting nuts; and (e) removing the clutch assembly from the clutch hub.

21. The method of claim 20 wherein said method further comprises the steps of:

(f) replacing the clutch assembly on the clutch hub after the necessary repair has been performed;

(g) replacing the spring tension adjusting nuts on the clutch assembly;

(h) removing the pushrod adjusting screw locknut from the pushrod adjusting screw;

(i) removing said elongated clutch removal tool from against the cover plate by grasping the sides of said elongated clutch removal tool; and (j) replacing the pushrod adjusting screw locknut on the pushrod adjusting screw.

* * * * *